United States Patent [19]

Seiferth

[11] 4,396,194

[45] Aug. 2, 1983

[54] GOLF PRACTICE PUTTING CUP

[76] Inventor: Oscar E. Seiferth, 5613 Taychopera Rd., Madison, Wis. 53705

[21] Appl. No.: 396,240

[22] Filed: Jul. 8, 1982

[51] Int. Cl.[3] ..... A63B 69/36

[52] U.S. Cl. ..... 273/178 A

[58] Field of Search ..... 273/176 B, 177 R, 177 A, 273/177 B, 178 R, 178 A, 180, 179 C

[56] References Cited

U.S. PATENT DOCUMENTS

| | | | |
|---|---|---|---|
| 1,182,480 | 5/1916 | Havens | 273/178 A |
| 1,427,537 | 8/1922 | Long | 273/178 A |
| 1,513,917 | 11/1924 | Long | 273/178 A |
| 2,031,525 | 2/1936 | Clarke | 273/178 R |
| 3,033,571 | 5/1962 | Botts | 273/177 A X |

*Primary Examiner*—George J. Marlo

*Attorney, Agent, or Firm*—Isaksen, Lathrop, Esch, Hart & Clark

[57] ABSTRACT

A golf practice putting cup is disclosed which is constucted of economical stock materials and is particularly arranged so that it can carry advertising indicia thereon so that the putting cup can serve as an advertising medium. The putting cup is formed from a base disc which has leaves which are folded up over an inner disc received within the leaves on the base disc, with the inner disc causing the leaves to angle upward so that a golf ball may roll into the interior of the cup but not out therefrom.

5 Claims, 6 Drawing Figures

Fig 1
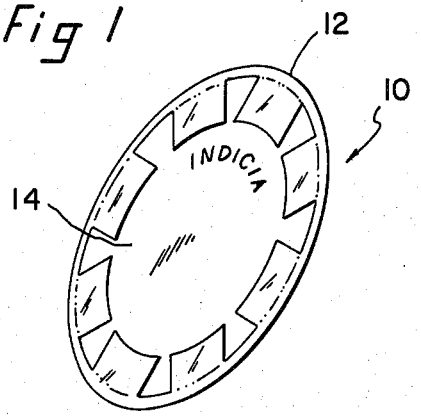
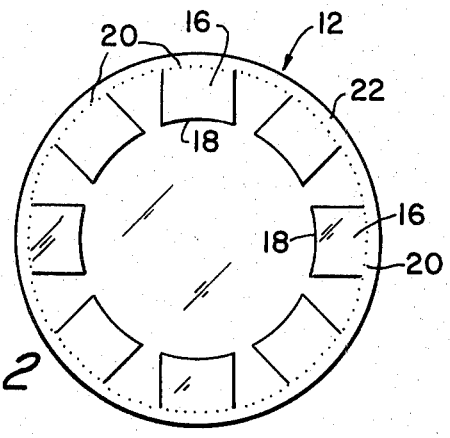
Fig 2
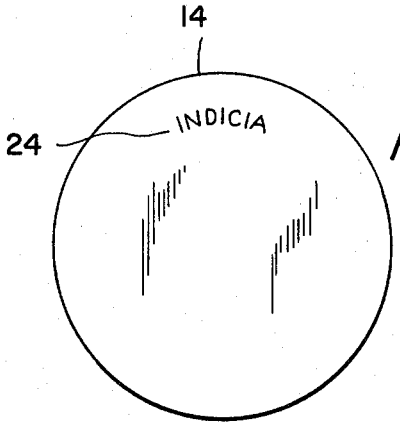
Fig 3
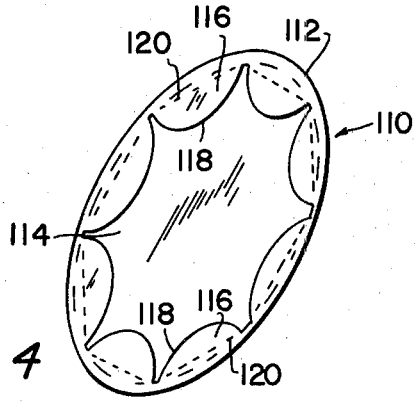
Fig 4

Fig 5
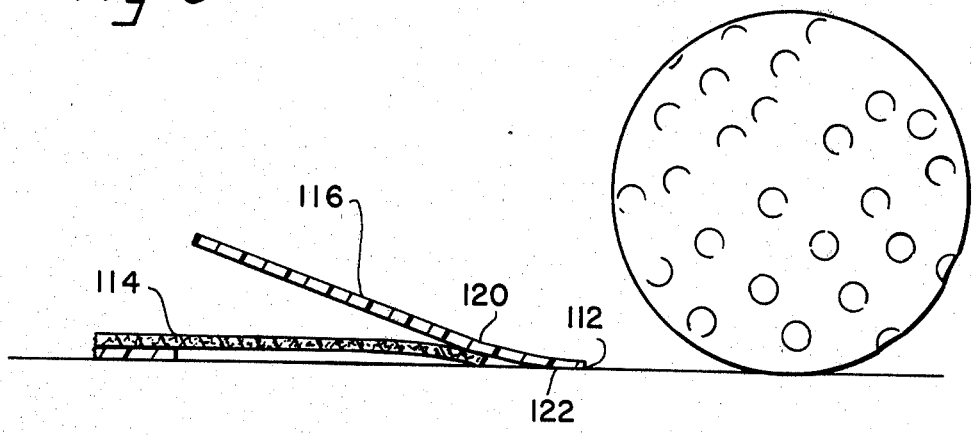
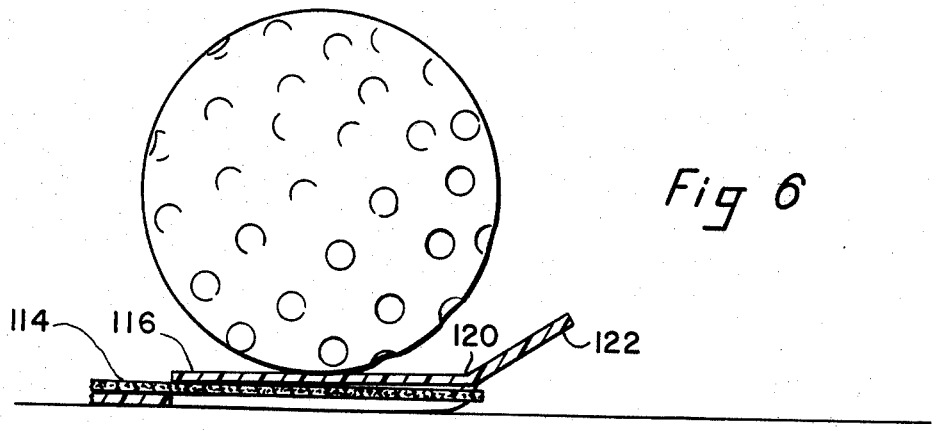
Fig 6

GOLF PRACTICE PUTTING CUP

TECHNICAL FIELD

The present invention relates to the general field of sports equipment an relates, in particular, to the field of practice putting cups for the game of golf.

DESCRIPTION OF THE PRIOR ART

The prior art is generally cognizant of the use of golf practice putting cups which are designed so that they may be utilized by a golfer to practice putting in indoor locations. It is generally acknowledged that such cups, generally circular in shape, can be constructed to have a lip or impediment over which the ball must roll into the interior of the cup and over which the ball tends not to roll once it is confined in the middle of the cup. A successful golf putting cup allows the ball to more easily roll into the hole than out thereof, thus generally imitating the action of an actual golf hole in which the ball falls into the cup on the golf green.

Examples are known in the patent literature of teachings of such golf practice putting cups. For instance, U.S. Pat. No. 1,513,917 illustrates an imitation hole for putting greens in which a cloth bottom member includes a number of radially disposed tabs to which are attached roller plates, which allow the golf ball to roll into the device, but not out thereof. U.S. Pat. No. 1,427,537 and Design Pat. No. 245,274 disclose artifical golf putting cups in which the ball has to roll over a resiliently biased angled metal plate into the interior of the cup where it is similarly restrained. Also known in the prior art are a number of teachings of golf putting cups which utilize a frusto-conically shaped piece of flexible sheet material arranged so that the ball can depress the material when going into the cup, but not out thereof. Examples of golf putting cups of this general design type can be seen in U.S. Pat. No. 1,076,722, No. 1,229,766, No. 1,823,487, No. 2,283,462 and No. 2,836,422.

SUMMARY OF THE INVENTION

The present invention is summarized in that a golf practice putting cup includes: a base disc of transparent stiff thermoplastic material; a circular inner disc of sheet material suitable for having advertising indicia printed thereon placed on top of the base disc, the inner disc being slightly smaller than the base disc; and a plurality of leaves cut from the base disc, each of the leaves attached to the base disc only by a hinge located at the outer peripheral edge of the leaf, the leaves arranged so that they may be folded up over the inner disc serving thereby both to restrain the inner disc in place and to form an impediment to help prevent a rolling ball from rolling out of the center of the cup.

It is an object of the present invention to provide a golf practice putting cup which is extremely economical in its manufacture and which is capable of carrying advertising indicia thereon, so that it can be utilized as an adverising medium for complementary or economically priced distribution of samples of the putting cup.

It is another object of the present invention to provide such a golf practice putting cup which is nevertheless efficient and realistic in its operations so as to mimic the behavior of an actual golf hole.

It is a further object to provide such a golf practice putting cup which is economical to manufacture by not requiring detailed assembly or molding operations in its manufacture and by being fabricated from economical and commercially available materials.

Other objects, advantages, and features of the present invention will become apparent from the following specification when taken in conjunction with the accompanying drawings.

BRIEF DESCRIPTION OF THE DRAWINGS

FIG. 1 is a perspective view of a golf practice putting cup constructed in accordance with the present invention.

FIG. 2 is a top plan view of the base disc of the putting cup of FIG. 1.

FIG. 3 is a top plan view of the inner disc of the putting cup of FIG. 1.

FIG. 4 is a perspective view of an alternative embodiment of a putting cup constructed in accordance with the present invention.

FIG. 5 is a view taken in section through the putting cup of FIG. 1 illustrating the configuration of the putting cup as a golf ball approaches it.

FIG. 6 is a side cross-sectional view, similar to FIG. 5, showing the configuration of the putting cup as a golf ball is entering the putting cup itself.

DESCRIPTION OF THE PREFERRED EMBODIMENT

Shown in FIG. 1, and generally illustrated at 10, is a golf practice putting cup constructed in accordance with the present invention. The putting cup 10 includes two major components, a base disc 12 and an inner disc 14, both illustrated in FIG. 1. The inner disc 14 rests on top of the base disc 12 as shown in FIG. 1, and is restrained in position therein as will be described in detail below.

The base disc 12 is illustrated in greater detail in FIG. 2. The base disc 12 is a circular disc preferably formed of transparent stiff material, such as 7.5 mil vinyl sheeting, or other stiff thermoplastic sheeting. The size of the base disc 12 is selected so as to approximate the size of a golf hole. Defined in the base disc 12 are a plurality of leaves 16. The leaves 16 have three of their sides defined by a score cut 18 which severs the leaf 16 from the adjoining sheet material of the disc 12. The leaf 16 is still attached to the remainder of the base disc 12 by a perforated score line 20 which is located at the outer peripheral edge of each of the leaves 16. As can be seen in FIG. 2, the score lines 20 as a group extend completely around the base disc 12 defining a peripheral lip 22 between the scorelines 20 and the outer extreme peripheral edge of the base disc 12. Preferably the peripheral lip 22 is uniform in dimension throughout the periphery of the base disc 12. Thus each of the leaves 16 is attached to the base disc 12 only by its attachment through the score line 20 to the peripheral lip 12, but is otherwise free to move without respect to the remaining portions of the base disc 12. The material of the base disc 12 is selected to have a suitable stiffness so that the leaves 16 retain their shape when deformed as illustrated below in FIGS. 5 and 6.

Shown in FIG. 3 is the inner disc 14. The inner disc 14 is formed of stock sheet material suitable for having advertising indicia printed thereon, with the indicia being indicated at 24 in FIG. 3. The advertising indicia may cover the entire front of the disc 14, or only may be limited to one portion thereof. The inner disc 14 is preferably formed of an economical material, such as kraft paperboard, and the inner disc 14 is selected in size to be slightly smaller than the base disc 12 and, preferably, to be just slightly smaller than the diameter of the circle described by the score line 20 on the base disc 12.

To assemble the putting cup 10 of FIG. 1 from the base disc 12 and the inner disc 14, the leaves 16 are folded upward along the score line 20 and the inner disc 14 is inserted underneath all of the leaves 16. Once this is done, each of the leaves 16 is bent upwardly by the presence of the inner disc 14, as illustrated by the leaf 116 shown in FIG. 5. It is for this reason that the diameter of the inner disc 14 is selected so as to be just slightly smaller than the diameter of the circle of the scope line 20, so that the peripheral edge of the inner disc 14 acts as a fulcrum to lever upward the leaves 16 so that they extend upward at an oblique angle as illustrated by the leaf 116 in FIG. 5.

Shown in FIG. 4 is an alternative embodiment of the putting cup constructed in accordance with the present invention, generally indicated at 110. Parts of the putting cup 110 similar to the parts of the putting cup 10 have been designated with similar reference numerals with the number 100 added thereto. In the putting cup 110, there are also two main structural elements, the base disc 112 and the inner disc 114, which is identical to the inner disc 14 of the putting cup 10. The inner disc 114 is inserted into the base disk 112 in the same fashion as with the putting cup 10. In the putting cup 110 of FIG. 4, however, the leaves 116 of the base disc 112 are constructed so as to be of a different configuration. In the base disc 112, each of the leaves 116 has an arcuate profile such that its inner edge 118 is defined by an arc of a circle and its outer dimension is defined by the score line 120, which is a linear segment forming a cord of the arc defined by the inner edge 118 of the leaf 116. The leaves 116 are cammed upwardly at an oblique angle by the presence of the inner disc 114 is a similar fashion as are the leaves 16 of the base disc 12 of the putting cup 10. In all other fashions, the putting cup 110 of FIG. 4 functions in a manner similar to the operation of the components of the putting cup 10 of FIG. 1. It can be understood from a comparison of the putting cups 10 and 110 that the leaves of the base disc can be cut in a wide variety of shapes and sizes without departing from the spirit of the present invention.

Shown in FIGS. 5 and 6 is the detail of the functioning of the parts of a putting cup according to the present invention when a golf ball approaches it. This operation is shown with the putting cup 110 of FIG. 4, but it is to be understood that the functioning of the parts of the putting cup function in a similar fashion for other designs of the leaves 16 or 116. As can be seen in FIG. 5, normally the outer edge of the inner disc 114 wedges the leaves 116 of the base disc 112 upwardly at an oblique angle as is illustrated in that figure. The golf ball is approaching the putting cup from the right as viewed in FIG. 5. When the ball approaches the cup, it rolls up onto the peripheral lip 122 of the base disc 112, and then rolls up onto the leaf 116. As can be seen in FIG. 6, the weight of the ball presses down the leaf 116 so that it rests flat against the inner disc 114. Since the material of the base disc 112 is selected to be of a relatively stiff character, the peripheral lip 122 of the base disc 112 is lifted up in the air, since the character of the material of the base disc 112 causes the angular relationship between the leaf 116 and the lip 122 to remain constant as the leaf 116 is pressed down by the ball. Adding to this phenomenon, the arcuate character of the peripheral edge of the base disc 112 causes the edge of the peripheral lip 122 to raise even further in the air, as indicated in FIG. 6. Thus the combination of the leaf 116 and the peripheral lip 122 is converted from an upwardly inclined ramp, as can be seen in the cross section of FIG. 5, to a flat, or even slightly downwardly inclined configuration, as illustrated in FIG. 6. This facilitates the entry of the ball into the interior of the portion of the putting cup 110, i.e. that portion of the putting cup 110 lying inside of the leaves 116. Once the ball rolls past the leaf 116 into the interior of the putting cup 110, the leaf 116 resiliently returns to its configuration as shown in FIG. 5. Clearly this orientation of the leaf 116 resists the movement of the ball out of the putting cup, i.e. from left to right as viewed in FIG. 5, so that the ball tends to remain in the interior of the putting cup 110. Thus the action of the leaf 116 and the lip 122 appears to "kick" the ball into the center of the putting cup 110, thus providing an action that appears to have some similarity to an actual golf hole.

Operating in this fashion, the putting cup 10 or 110 tends to imitate the operation of an actual golf hole. If the ball has sufficient momentum to carry it onto the leaf 16 or 116, the leaf will be depressed and the ball will roll into the interior of the cup. Once into the interior of the cup, the ball will not roll out because of the action of the leaves 16 or 116 which inhibit the outward movement of the ball. While the leaf 16 or 116 tends to assume the angular orientation as shown in FIG. 5, since it is not extremely rigid and is not biased by any spring or any other mechanical orienting device, it is relatively easy for the ball to flatten the leaf into the flat position as shown in FIG. 6. In this way, the putting cup does not present any significant artificial barrier to the ball rolling into it as sometimes occurs in other putting cups known in the prior art.

It is an advantage of the putting cup of the present invention in that it is constructed of relatively economical materials and is capable of carrying advertising thereon, so that the putting cup 10 or 110 can be distributed in a complimentary fashion as an advertising medium. Since the inner disc 14 or 114 can be formed of paperboard or other material upon which advertising indicia 24 can easily be printed, the putting cup can carry any advertiser's message or combination of messages. Since both of the two major structural components of the putting cup 10 or 110, the base disc 12 or 112, and the inner disc 14 or 114, are easily cut from relatively economical and commercially available stock materials, the putting cup is extremely economical to fabricate and can be made economically in large quantities. Thus the putting cup can affordably be manufactured to be distributed at low cost, or even complimentarily, in order to disseminate the advertising information of the advertiser whose message is placed upon the inner disc 14 or 114. Furthermore, since the only operation which needs to be performed on the base disc 112 is a cutting and scoring operation which can be performed in a single die cut, both portions of the putting cup are relatively easy and efficient to manufacture.

It is to be understood that the present invention is not limited to the particular construction and arrangement of parts illustrated herein, but embodies all such modified forms thereof as come within the scope of the following claims.

I claim:

1. A golf practice putting cup comprising:

a base disc (12, 112) of stiff sheet material;

a circular inner disc (14, 114) of sheet material suitable for having advertising indicia printed thereon placed on top of the base disc, the inner disc (14, 114) being slightly smaller than the base disc (12, 112); and a plurality of leaves (16, 116) cut from the base disc (12, 112), each of the leaves (16, 116) attached to the base disc (12, 112) only by a hinge (22, 122) located at the outer peripheral edge of the leaf (16, 116), the leafs (16, 116) arranged so that they may be folded up over the inner disc (14, 114) serving thereby both to restrain the inner disc (14, 114) in place and to form an impediment to help prevent a rolling golf ball from rolling out of the center of the cup.

2. A golf practice putting cup as claimed in claim 1 wherein each of the base disc (12, 112) and the inner disc (14, 114) are circular in shape.

3. A golf practice putting cup as claimed in claim 2 wherein each of the hinges (20) joining each of the leaves (16) to the base disc (12) forms a portion of a circle having a diameter slightly larger than the diameter of the inner disc (14).

4. A golf practice putting cup as claimed in claim 3 wherein a peripheral lip (22) is defined between the score line (20) and the outside peripheral edge of the base disc (12), each of the leaves (16) being joined to the base disc (12) by being attached by the score line (20) only to the peripheral lip (22).

5. A golf practice putting cup as claimed in claim 2 wherein each of the leaves (116) has an arcuate shape on its inner side and wherein the score line (120) joining each of the leaves (118) to the base disc (112) is a straight line.

* * * * *